US005547395A

United States Patent [19]

Delamotte

[11] Patent Number: 5,547,395

[45] Date of Patent: Aug. 20, 1996

[54] COAXIAL CABLE TERMINATION ARRANGEMENT

[75] Inventor: Jean C. Delamotte, Henonville, France

[73] Assignee: Raychem S.A., France

[21] Appl. No.: 256,664

[22] PCT Filed: Feb. 16, 1993

[86] PCT No.: PCT/GB93/00326

§ 371 Date: Jul. 19, 1994

§ 102(e) Date: Jul. 19, 1994

[87] PCT Pub. No.: WO93/16503

PCT Pub. Date: Aug. 19, 1993

[30] Foreign Application Priority Data

Feb. 17, 1992 [GB] United Kingdom ..... 9203289

[51] Int. Cl.[6] ..... H01R 17/04

[52] U.S. Cl. ..... 439/578; 439/161; 439/730; 439/874; 439/932

[58] Field of Search ..... 174/8; 439/161, 439/730, 578, 874, 932

[56] References Cited

U.S. PATENT DOCUMENTS

| | | | |
|---|---|---|---|
| 2,027,962 | 1/1936 | Cook et al. | 18/55 |
| 3,086,242 | 4/1963 | Cook | 18/1 |
| 3,597,372 | 8/1971 | Cook | 260/4 |
| 3,985,950 | 10/1976 | Maltz | 174/88 |
| 4,781,605 | 11/1988 | Herubel et al. | 439/161 |
| 4,878,851 | 11/1989 | Mullen, III | 439/876 |
| 4,981,451 | 1/1991 | Undin et al. | 439/885 |
| 5,167,545 | 12/1992 | O'Brien et al. | 439/874 |

FOREIGN PATENT DOCUMENTS

| | | |
|---|---|---|
| 0091319 | 10/1983 | European Pat. Off. . |
| 2463467C2 | 8/1990 | Germany . |
| 1203276 | 8/1970 | United Kingdom . |
| 1508997 | 4/1978 | United Kingdom . |
| WO88/09068 | 11/1988 | WIPO . |
| WO90/09255 | 8/1990 | WIPO . |

*Primary Examiner*—P. Austin Bradley
*Assistant Examiner*—Jill DeMello
*Attorney, Agent, or Firm*—Herbert G. Burkard; Sheri M. Novack

[57] ABSTRACT

A termination arrangement for a coaxial cable comprises a dimensionally heat-recoverable sleeve that encloses a connecting element for the screen of the cable and a quantity of solder for forming a permanent electrical connection between the connecting element and the cable screen. The connecting element has a generally cylindrical portion whose diameter is capable of changing and which is held in a state of larger diameter by the solder and/or the sleeve, the element changing to a smaller diameter state when the sleeve is recovered. In use, the arrangement is positioned over a coaxial cable which has been prepared so as to expose an appropriate length of the central conductor, dielectric and screen. when the sleeve is recovered, the solder fuses and the connecting element contracts around the screen.

4 Claims, 2 Drawing Sheets

COAXIAL CABLE TERMINATION ARRANGEMENT

This invention relates to the formation of electrical connections to coaxial cables and especially to the termination of the screens of such cables.

In modern communication systems it is important that connections to coaxial cables, for example connections between cables employing a coaxial connection, connections to printed circuit boards and the like, are impedance matched in order to minimize the amplitude of signal reflections. Clearly also the connections should be made with a low installed cost. At present coaxial cables are usually terminated at coaxial connectors in one of three ways: by crimping, by clamping or by means of solder. The solder arrangements generally exhibit the best electrical performance but are normally employed only for prototype assembly in view of their cost, whereas the crimp type of termination exhibits relatively poor electrical characteristics but is susceptible to relatively high volume production. In addition, it is often not possible to make crimp replacement terminations in the field. Cable clamp arrangements, on the other hand, can be employed in the field but are only susceptible to low volume production.

According to the present invention, there is provided a termination arrangement for a coaxial cable, which comprises a dimensionally heat-recoverable sleeve that encloses a connecting element for the screen of the cable and a quantity of solder for forming a permanent electrical connection between the connecting element and the cable screen, the connecting element comprising a ferrule having a generally cylindrical portion which has one or more axial slits that allow its diameter to change and which is held in a state of larger diameter by the solder and/or the sleeve, the element changing to a smaller diameter state when the sleeve is recovered.

In order to terminate the screen of a coaxial cable, the cable jacket, screen and dielectric layer are each cut back in order to expose an appropriate length of the central conductor, dielectric and screen, the arrangement is positioned over the cable so that the exposed length of the cable screen is located within the generally cylindrical portion of the connecting element, and the assembly is briefly heated, for example by means of an infrared lamp or a hot-air gun, in order to cause the sleeve to recover, the solder to fuse and the connecting element to contract around the cable screen. The arrangement according to the invention has the advantage that it is relatively simple in construction, thereby allowing high volume production, but can form a termination with a high degree of impedance matching with the cable. In addition, it is possible to repair a cable screen termination with one according to the invention in the field. As is well known, the degree to which different parts of a coaxial line are impedance matched will depend on the ratio of diameters of the screen and the central conductor as well as the relative permittivity of the dielectric. According to the present invention, the connecting element may be configured so that, when the termination arrangement is installed about a coaxial cable, the connecting element will contract to a predetermined value but no more. Thus, the connecting element may be arranged so that it will contract enough to form a snug fit with the outer surface of the exposed screen without deforming the screen significantly and thereby affecting the characteristic impedance of that part of the cable. Although the connecting element does not compress the cable screen enough to deform it significantly, i.e. enough to alter the impedance characteristics, a good electrical connection will be formed between the connecting element and the cable screen due to the solder.

The arrangement may be employed in any of a number of configurations. For example the connecting element may be biassed to a state of smaller diameter and be held in its state of larger diameter by the solder and/or by the sleeve so that when the arrangement is heated and the solder fuses or the heat-recoverable sleeve material becomes taught the parts forming the connecting element will be allowed to move toward one another. Alternatively, the connecting element may be forced into its state of smaller diameter by recovery of the sleeve. Whichever form is employed it is important that the distance through which the parts of the connecting element are allowed to move together is defined in order not to crush the coaxial cable. This may be achieved, for example by providing the connecting element with one or more axial slits (or slots) that allow its diameter to change but will prevent further contraction of the connecting element once the slits have closed. The slits may extend the entire length of the connecting element if desired. In this case, if more than one slit is present this will necessarily mean that the connecting element is formed in more than one part, each part being supported by the sleeve wall. Preferably, however, the connecting element is formed in one piece which means that it will have only one slit that extends the entire length of the element or that the slits extend only partly along the element. In another form of arrangement the connecting element (or at least the generally conical part of it) may be formed as a spring, e.g. a spring that is generally uniform along its axis and has a spiral cross-section, or a generally helicoidal spring, so that the element may contract by coiling up.

In the case of a connecting element in the form of a spring, it may be formed from sheet metal, e.g. spring steel, berylium copper or hard tempered copper or from wire (formed, for example, from the same materials) which may have a circular or polygonal cross-section. In the case of elements being provided with slits, the element may be machined from a solid block of metal, e.g. brass, or it may be formed by pressing it out of a strip of metal. In the latter case it may be appropriate and simplify handling of the arrangements if they are retained on the strip until use. Thus, the invention also provides an array of termination arrangements according to the invention in which the connecting elements of the termination arrangements have been formed on a strip of metal and are individually removable from the strip. Such an array may be employed merely in order to simplify handling of the individual arrangements intended to be located on separate coaxial cables or it may be employed simultaneously to terminate a number of coaxial cables which form part of a composite cable, by means of automatic or semiautomatic wire handling equipment.

Although it will normally be necessary for a termination to be designed to fit one size of cable only, a single arrangement may be designed to fit several different types of connector systems, for example coaxial connectors including coaxial contacts, and bulkhead feedthroughs, and terminations to printed circuit boards. Thus, according to yet another aspect, the invention provides a connector for a coaxial cable, which comprises a male or ferrule contact for the central conductor of the cable, a termination arrangement according to the invention for terminating the screen of the cable, and a connecting piece which holds the termination arrangement and the central conductor contact, the connecting piece providing screen continuity for the cable.

As stated above, the sleeve is dimensionally heat-recoverable, that is to say the article has a dimensional configuration that may be made substantially to change when subjected to heat treatment.

Usually these articles recover, on heating, towards an original shape from which they have previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate state.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Any material to which the property of dimensional recoverability may be imparted may be used to form the sleeve. Preferred materials include low, medium or high density polyethylene, ethylene copolymers, e.g. with alpha olefins such as 1-butene or 1-hexene, or vinyl acetate, polyamides or fluoropolymers, e.g. polytetrafluoroethylene, vinylidine fluoride or ethylene-tetrafluoroethylene copolymer.

Also, as mentioned above, the arrangement includes a quantity of solder, i.e. a quantity of soft solder as distinct from brazing material, for forming a permanent solder connection. The solder may, for example, simply be in the form of an $Sn_{63}Pb_{37}$ eutectic composition which will melt as the device is heated and the sleeve recovers, or more than one solder composition having differing melting points may be employed, as described in International Application No. WO88/09068. In this form of device, melting of the higher melting point component, e.g. $Sn_{96.5}Ag_{3.5}$ eutectic will provide a visual indication that the device has been heated sufficiently to melt the lower melting point composition and to form a satisfactory solder joint. If desired the lower melting point solder may be a non-eutectic composition and, for example as described in International Application No. PCT/GB90/00234, the higher and lower melting point solder compositions may together form a eutectic composition. For example, a non-eutectic $Sn_{60}Pb_{40}$ lower melting point component may be employed with a higher melting point component formed from pure tin in relative amounts that an $Sn_{63}Pb_{37}$ eutectic is formed. The disclosures of these two patent applications are incorporated herein by reference. An advantage of employing a two component solder, and especially a tin, $Sn_{60}Pb_{40}$ combination is that it reduces the possibility of "wicking" that is to say, travel of the solder along the conductors and away from the joint area due to capillary action by the strands of the screen, which can be caused by prolonged heating of the device.

The solder may be positioned anywhere where it will be able to flow into the connecting element to form a solder joint. The solder may be employed in the form of a ring or in any other form for example a ball, and may be disposed symmetrically about the connecting element axis or offset from it.

Several forms of termination arrangement in accordance with the present invention will now be described by way of example with reference to the accompanying drawings, in which.

Figure 1:
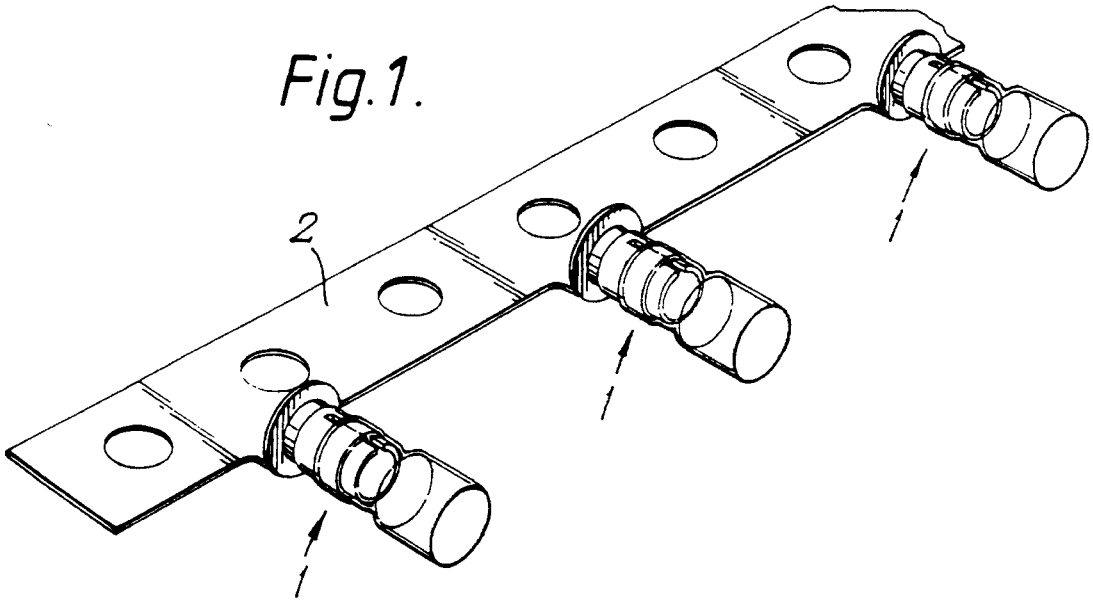
FIG. 1 is a perspective view of an array of termination arrangements according to the invention located on a metal strip.
Figure 2:
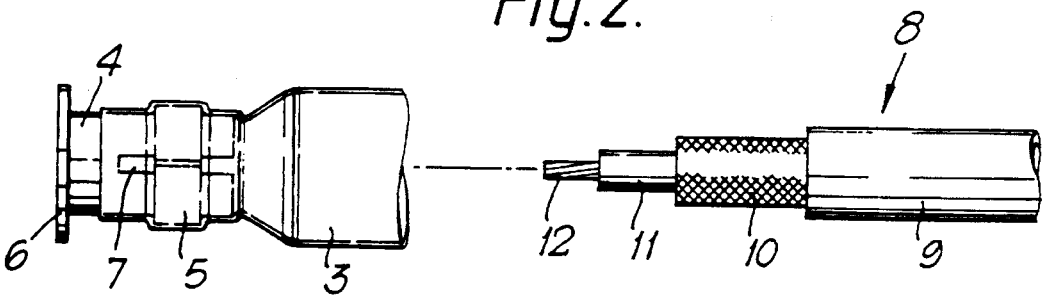
FIG. 2 is a side view showing one of the termination arrangements of FIG. 1 together with a length of coaxial cable.

Referring to the accompanying drawings, FIG. 1 shows an array of devices 1 for terminating the screens of coaxial cables according to the present invention located on a metal sheet 2. The devices 1, one of which is shown in FIG. 2, each comprises a heat-shrinkable transparent sleeve 3 formed from radiation crosslinked polyvinylidine fluoride that has been partially shrunk onto a machined brass ferrule 4 and a solder ring 5 that is located on the ferrule. The ferrule 4 is generally cyclindrical and has a flange 6 at one end thereof for location of the termination assembly in a connector of the like. Also, the ferrule has a pair of axially extending slots 7 that extend from the other end of the connecting element that is located inside the shrinkable sleeve 3 and extends about two thirds the length of the ferrule, so that the solder ring 5 is located over the slots.

In order to terminate the screen of a coaxial cable 8, the jacket 9, screen 10, for example in the form of a braid, and dielectric 11 are each cut back so that appropriate lengths of the central conductor 12, dielectric 11 and screen 10 are exposed. The coaxial cable is then inserted into the open end of the device until the central conductor 12 and dielectric extend through the ferrule 4 and the screen is located within the ferrule. The assembly is then heated in order to recover the sleeve 3 about the cable and to fuse the solder ring 5. At the same time the contraction of the sleeve 3 causes the opposed parts of the ferrule 4 that are separated from one another by the slots 7 to move toward one another into contact with the cable screen. The fused solder 5 will form a good electrical contact between the cable screen 10 and the ferrule 4 and remove any air gaps between them.

Figure 3:
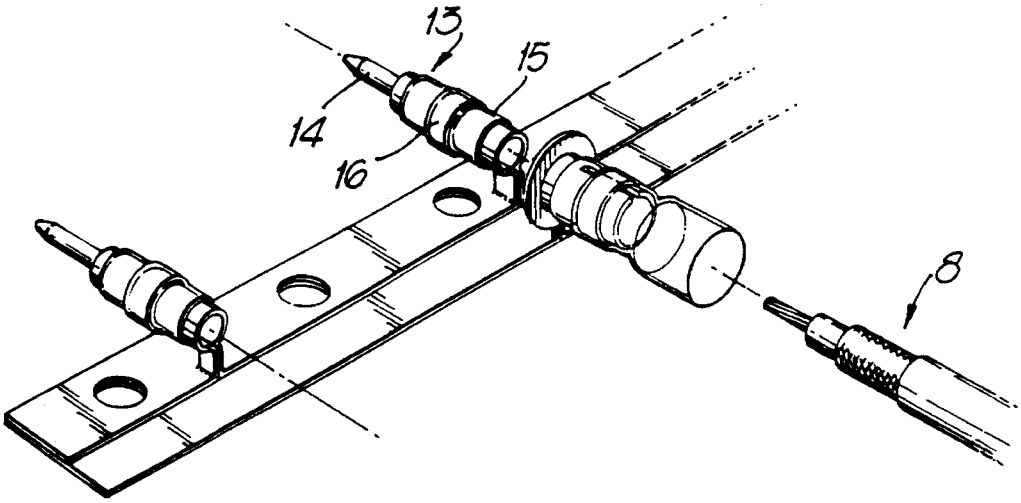
FIG. 3 is a perspective view of one of the termination assemblies located on a metal strip together with a length of coaxial cable and a contact terminal for the centre conductor of the cable.

FIG. 3 shows the arrangement of FIG. 1 (in which only one termination device 1 is shown) in combination with a separate array of devices 13 (of which only one is shown) for forming a pin or male contact for the central conductor of the coaxial cable. Both arrays of devices are mounted on a strip 2 of metal, in this case the strips being formed from the same material from which the ferrule 4 of the screen termination array and the pin 14 of the central conductor termination array is formed, the ferrules 4 and the pins 14 normally being stamped out of the strips 2. The pin contact devices 13 and the screen termination devices are in register so that an approximately cut back coaxial cable 8 can be located in both devices and both the central conductor and the cable screen can be terminated simultaneously by heating both devices. The central conductor terminating device 13 also includes a solder ring 16 and is enclosed in a thin sleeve of heat-shrinkable polyvinylidine fluoride 15 so that, after heating, insulated solder joints are formed to both conductors.

This form of array may be employed to terminate coaxial cables individually or they may be used to terminate a number of cables simultaneously, for example by means of automatic or semi-automatic equipment.

The coaxial cables terminated in this way may then be located in any of a number of different coaxial cable connectors, for example a BNC, SMA or TNC connector, or the like, in which a conductive housing is employed to provide screen continuity between the two coaxial cables.

Figure 4:
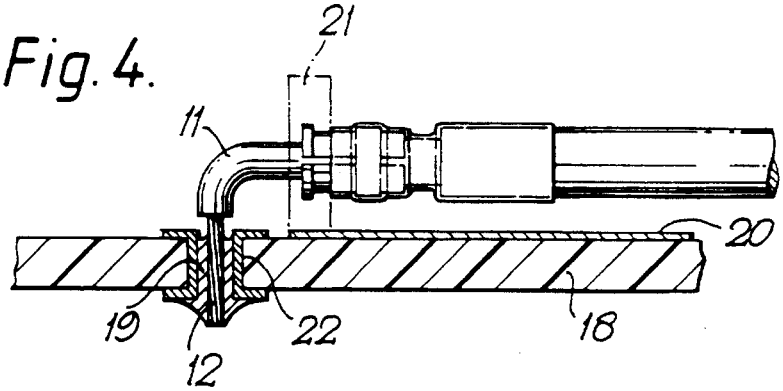
FIG. 4 is a side view of a pcb connection according to the invention.

The central conductor need not, however, also be terminated. For example the connection of a coaxial cable to a printed circuit board 18 is shown in FIG. 4 in which the cable screen is terminated as above but the central conductor 12 and dielectric 11 are bent at 90° to the rest of the cable in order to be introduced into a through hole or via 19 of the board. The cable screen is connected to a conductive track 20 on the board via the ferrule 4 and a ferrule holding fixture 21 shown schematically while the central conductor 12 of the cable is soldered to a conductive lining 22 of the through hole 19.

Figure 5A:
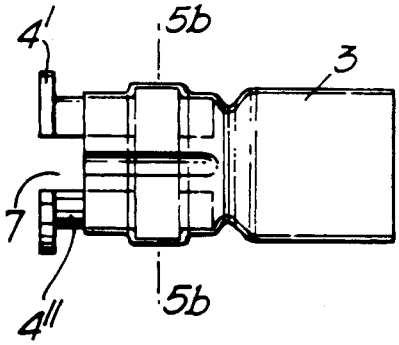
FIGS. 5 and 6 show further forms of termination arrangement according to the invention.
Figure 5B:
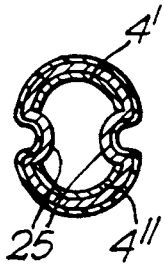
Figure 5C:
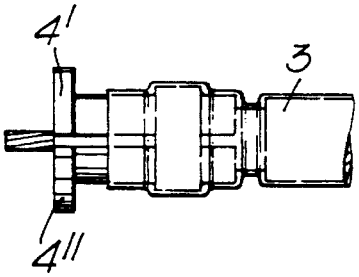

FIG. 5 shows schematically one alternative form of termination arrangement according to the invention in which the connecting element or ferrule is formed in two halves 4' and 4" (this corresponding in principle to the ferrule of FIG. 1 in which the slots 7 extend the entire length of the ferrule. In this embodiment both ferrule halves 4' and 4" are held in the heat-shrinkable sleeve 3 separated from one another by axially extending indentations 25 in the solder ring 5, and optionally also by axially extending indentations in the sleeve 3 which extend the slot between the two halves 4' and 4" of the ferrule and prevent them moving toward one another. The indentations will normally be formed by a punching operation. When the device is heated the solder ring 5 fuses and the wall of the sleeve 3 becomes taught, thereby allowing the two ferrule halves 4' and 4" to move toward one another under the recovery forces of the sleeve 3 as shown in FIG. 5*c*.

Figure 6:
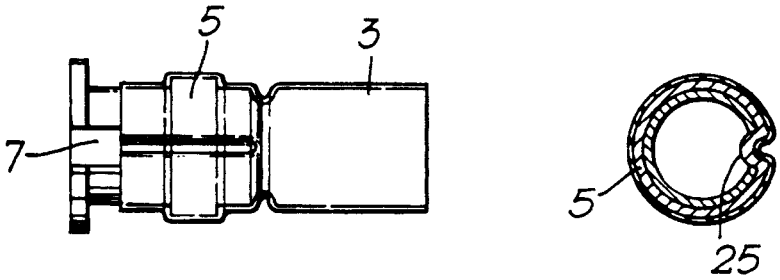

Another alternative form of device is shown in FIG. 6. In this device the ferrule 4 has a single slot 7 that extends along the entire length of the ferrule but does not divide it into two halves. The solder ring 5 and optionally also the sleeve 3 may be provided with an axially extending indentation 25 similar to that shown in FIG. 5 which extends into the slot 7 and prevents it closing. In this embodiment the ferrule 4 may be biased to close the slot 7, closing being prevented by the solder indentation, so that when the device is heated during installation the ferrule 4 will begin to contract in diameter under its own influence as soon as the solder indentation 25 and any sleeve indentation has disappeared.

Figure 7A:
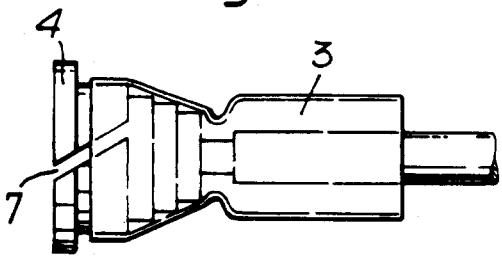
FIG. 7 shows yet another form of termination.
Figure 7B:
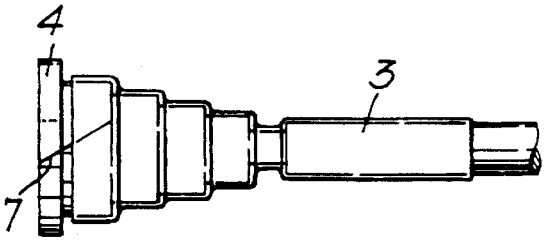

Yet another form of device is shown schematically in FIG. 7, in its initial form in FIG. 7*a* and in its recovered form in FIG. 7*b*. In this form of device the connecting element has a helicoidal configuration and will contract radially under the action of the heat-shrinkable sleeve 3 or under its own action, when the assembly is heated. One end of the connecting element or ferrule 4 has a slot 7 which closes as the element contracts radially and then prevents and substantial subsequent contraction.

I claim:

1. A termination arrangement for a coaxial cable, which comprises a dimensionally heat-recoverable sleeve that encloses a connecting element for a screen of the cable and a quantity of solder for forming a permanent electrical connection between the connecting element and said screen, the connecting element (a) comprising a ferrule having a generally cylindrical portion which has one or more axial slits that allow its diameter to change and (b) being biased to a state of relatively smaller diameter and being held in a state of relatively larger diameter by means of at least one of the solder and the sleeve being located within part of said at least one of the slits, the element changing to a smaller diameter state when the sleeve is recovered.

2. An arrangement as claimed in claim 1, wherein the connecting element has been formed in one piece.

3. An array of termination arrangements, each of which is as claimed in claim 1, in which the connecting elements of the termination arrangements have been formed on a strip of metal and are individually removable from the strip.

4. A connector for a coaxial cable, which comprises a contact for the central conductor of the cable, a termination arrangement as claimed in claim 1 for terminating the screen of the cable and a connecting piece which holds the termination arrangement and the central conductor contact, the connecting piece providing screen continuity for the cable.

* * * * *

UNITED STATES PATENT AND TRADEMARK OFFICE

CERTIFICATE OF CORRECTION

PATENT NO. : 5,547,395
DATED : August 20, 1996
INVENTOR(S) : Jean C. Delamotte

It is certified that error appears in the above-indentified patent and that said Letters Patent is hereby corrected as shown below:

Column 2, line 58, delete "ferrule"; insert --female--.

Signed and Sealed this

Eighth Day of April, 1997

*Attest:*

Bruce Lehman

BRUCE LEHMAN

*Attesting Officer*

*Commissioner of Patents and Trademarks*